US011168532B2

(12) United States Patent
Mukhlifi

(10) Patent No.: US 11,168,532 B2
(45) Date of Patent: Nov. 9, 2021

(54) METHOD AND APPARATUS FOR SACRIFICIAL WELLHEAD PROTECTOR AND TESTING ADAPTER

(71) Applicant: Saudi Arabian Oil Company, Dhahran (SA)

(72) Inventor: Mohammed E. Mukhlifi, Ad Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 19 days.

(21) Appl. No.: 16/810,901

(22) Filed: Mar. 6, 2020

(65) Prior Publication Data

US 2021/0277738 A1 Sep. 9, 2021

(51) Int. Cl.

| | |
|---|---|
| ***E21B 33/03*** | (2006.01) |
| ***E21B 47/06*** | (2012.01) |
| ***E21B 33/06*** | (2006.01) |

(52) U.S. Cl.

CPC ..... *E21B 33/03* (2013.01); *E21B 33/06* (2013.01); *E21B 47/06* (2013.01)

(58) Field of Classification Search

CPC ..... E21B 33/03; E21B 33/04; E21B 33/06; E21B 33/068; E21B 33/0353

See application file for complete search history.

(56) References Cited

U.S. PATENT DOCUMENTS

| | | | | |
|---|---|---|---|---|
| 4,554,976 | A | 11/1985 | Hynes et al. | |
| 5,890,541 | A | 4/1999 | Jennings et al. | |
| 6,557,630 | B2 | 5/2003 | Harkins et al. | |
| 6,873,267 | B1 | 3/2005 | Tubel et al. | |
| 7,032,677 | B2 | 4/2006 | McGuire et al. | |
| 7,207,384 | B2 | 4/2007 | Dallas et al. | |
| 7,296,631 | B2 | 11/2007 | McGuire et al. | |
| 7,308,934 | B2 * | 12/2007 | Swagerty | E21B 33/068 166/177.5 |
| 7,481,269 | B2 * | 1/2009 | Dallas | E21B 17/1007 166/75.14 |

(Continued)

FOREIGN PATENT DOCUMENTS

WO 2017120338 A1 7/2017

OTHER PUBLICATIONS

International Search Report and Written Opinion for International Application No. PCT/US2021/070243, dated May 31, 2021; pp. 1-13.

*Primary Examiner* — Kenneth L Thompson
(74) *Attorney, Agent, or Firm* — Bracewell LLP; Constance G. Rhebergen; Vivek P. Shankam

(57) ABSTRACT

An apparatus or a well tool for testing a blowout preventer (BOP) on a surface wellhead. The apparatus includes a sacrificial wellhead adapter, a top locking mechanism adapted to lock the adapter to a BOP riser, and a bottom locking mechanism adapted to lock the adapter to a permanent tubing or casing spool of the surface wellhead. The apparatus further includes a plurality of lock down screws configured to be activated as a load ring. The sacrificial wellhead adapter further comprises a first profile for accommodating a test plug load ring, and a sealing profile for a test plug. The apparatus further includes a test plug with an activated load shoulder. The test plug is activated externally by energizing the lock down screws. The apparatus further includes a load ring configured to lock the test plug in place.

13 Claims, 4 Drawing Sheets

(56) References Cited

U.S. PATENT DOCUMENTS

| | | | | |
|---|---|---|---|---|
| 7,823,634 | B2 * | 11/2010 | Chan | E21B 33/068 166/86.3 |
| 7,967,066 | B2 | 6/2011 | Mcstay et al. | |
| 8,899,315 | B2 * | 12/2014 | Nguyen | E21B 33/03 166/85.3 |
| 9,388,659 | B2 | 7/2016 | Redden et al. | |
| 10,273,775 | B2 | 4/2019 | Cruickshanks et al. | |
| 2007/0107910 | A1 | 5/2007 | McGuire et al. | |
| 2009/0032241 | A1 | 2/2009 | Allen et al. | |
| 2015/0315869 | A1 | 11/2015 | Landry | |

* cited by examiner

METHOD AND APPARATUS FOR SACRIFICIAL WELLHEAD PROTECTOR AND TESTING ADAPTER

TECHNICAL FIELD

Embodiments relate in general to surface well tools and in particular to a tool that can be installed on top of existing wellhead and provide protection for existing wellhead component and testing for a blowout preventer located above.

BACKGROUND

In offshore drilling, a surface wellhead is installed at the platform. Typically a riser connects to the wellhead and extends upward to the drilling floor. A blowout preventer stack, hereinafter referred to as a "BOP," is located within the riser.

It is generally good practice to test a BOP by closing the BOP on drill pipe and applying pressure below the drill pipe. In addition, it is a good practice to test full closure of the BOP with the drill pipe pulled above the BOP. These operations also test the seal of the wellhead riser to the existing surface wellhead component below the riser. There are often legal requirements to perform BOP tests at regular intervals. This typically involves abandoning drilling operations prior to reaching target depth and pulling the drill string back to surface.

BOPs are used for controlling a well during drilling rig operations. In some types of offshore drilling, the BOP is attached to a wellhead from which well casing is hung and cemented into the well bore. Attached to the BOP is a riser system extending to a rig floor.

The individual BOPs are generally required to be tested by regulatory authorities in the interest of safety and ecology. Such tests have been conducted in the past by lowering a test tool from the rig floor through the riser and through the open bores of the individual blowout preventers in the stack for sealing in the wellhead below the BOP stack. The individual blowout preventers, with the exception of the shear ram, have been tested by pressuring the stack through the means of a choke or kill line with pressurized drilling fluid. Each individual blowout preventer is tested in turn by closing the preventer about the drill pipe and determining whether or not the preventer maintains the pressure from below. In the past the shear ram preventer in the stack has simply not been tested (because its shearing blades would shear the drill pipe) or has been tested to a low pressure against a cement plug in the casing while drill pipe was removed from the well bore.

With increasing interest in countries demanding the utmost in safety of its offshore waters, some governments have begun demanding that all elements in the BOP stack be tested periodically to full rated working pressure. Such a requirement has demanded that the shear ram blowout preventer also be tested.

A prior method and apparatus for testing the blowout preventers, including the shear ram blowout preventer, has been used. Such an apparatus has included a sealing test tool which is lowered by means of a drill pipe through the aligned bores of the individual blowout preventers of the surface BOP stack until it is landed in the wellhead. Such a sealing test tool (for example, test plug) has included therein a bore for communication with the interior of the drill pipe. The bore had been prepared for insertion of a check valve adapted to prevent downward fluid flow yet allowing flow to the interior of the drill pipe from beneath the sealing test tool in the wellhead. Such a check valve has enabled operators to check the efficiency of the sealing tool in sealing about the wellhead. When the stack is pressured by means of a choke or kill line, leakage below the sealing test tool could be detected in the interior of the drill pipe at the surface because of flow upwardly through the check valve.

Also included in the apparatus has been a backout sub connected between the sealing test tool and the drill pipe which may be disconnected, leaving the sealing test tool in the wellhead yet allowing the drill pipe to be raised above the shear ram blowout preventer for its testing. Such a backout sub has been provided with left hand threads connecting an upper part of the sub with a lower part such that the drill pipe may be disconnected from the lower part of the backout sub and the attached sealing test tool in the wellhead by turning the drill pipe to the right, thereby disconnecting the drill pipe and the upper part of the sub from the lower part of the sub. In order to reconnect the upper part of the sub and the drill pipe with the lower part of the sub, it has in the past been necessary to "trip" the drill pipe. That is, the drill pipe is raised joint by joint to the surface, such that a connector with right hand threads may be provided on the upper part of the sub. When the drill pipe is lowered (again, joint by joint) back down through the riser and through the BOP stack, it was then possible to reconnect the upper part of the sub to a second set of right hand threads on the lower part of the sub. A right hand turning of the drill pipe could again connect the upper part of the sub with the lower part of the sub.

The industry has recognized the advantage of being able to disconnect from the lower part of the sub and reconnect to the lower part of the sub after the shear ram blowout preventer has been tested. A single set of left hand threads could be provided to connect the upper and lower parts of the sub. Such a connection would require disconnection by turning to the right and reconnection by turning to the left, a procedure which would eliminate the necessity of tripping the drill pipe. Turning only to the right to disconnect and then reconnect the upper part of the sub and the lower part of the sub obviates the possibility of disconnecting one of the joints of the drill pipe which are typically connected with right hand threads. In offshore wells, tripping all of the drill pipe during drilling operation will cause considerable delay in the testing process, a process which must be accomplished periodically during drilling. Drilling delays in offshore operations are very expensive.

SUMMARY

Accordingly, a time saving method is to not pull the drill pipe all the way to the surface and hang the drill pipe to the test apparatus. This saves the tripping time of the drill pipe and thus reducing the operation time. In order to hang the testing apparatus to the drill pipe, the bowl protector inside the wellhead has to be retrieved. By retrieving the protector and running the test apparatus with drill pipe hung to it, there is always a risk of damaging or scoring the existing wellhead component. In case there is some damage, the wellhead component has to be replaced with a new one. This can be done by pulling the drill pipe, securing the well, and replacing the damaged wellhead component. This is a time consuming operation and very expensive.

To mitigate this risk, a sacrificial adapter can be installed on top of the existing wellhead component, which adapter has a profile to allow installing the test apparatus and the protector without the need to pull the drill pipe out of the hole. This adapter can take the damage and mitigate the risk of damaging the existing wellhead component. This results in operation time saving and cost reduction.

One example embodiment is an apparatus or a well tool for testing a blowout preventer (BOP) on a surface wellhead. The apparatus includes a sacrificial wellhead adapter, a top locking mechanism adapted to lock the adapter to a BOP riser, and a bottom locking mechanism adapted to lock the adapter to a permanent tubing or casing spool of the surface wellhead. The apparatus further includes a plurality of lock down screws configured to be activated as a load ring. The sacrificial wellhead adapter further comprises a first profile for accommodating a test plug load ring, and a sealing profile for a test plug. The apparatus further includes a test plug with an activated load shoulder. The test plug is activated externally by energizing the lock down screws. The apparatus further includes a load ring configured to lock the test plug in place. The apparatus further includes a bowl protector to protect the sacrificial wellhead adapter and the permanent casing or tubing spool seal profile. The bowl protector comprises a top elastomeric seal and a bottom elastomeric seal. The bowl protector is retained in place by the lock down screws.

BRIEF DESCRIPTION OF THE DRAWINGS

All aspects and features of certain example embodiments of the present disclosure will be more apparent from the following description taken in conjunction with the accompanying drawings, in which.

DETAILED DESCRIPTION

The particulars shown here are by way of example and for purposes of illustrative discussion of the examples of the subject disclosure only, and are presented in the cause of providing what is believed to be the most useful and readily understood description of the principles and conceptual aspects of the subject disclosure. In this regard, no attempt is made to show more detail than is necessary, the description taken with the drawings making apparent to those skilled in the art how the several forms of the subject disclosure may be embodied in practice. Furthermore, like reference numbers and designations in the various drawings indicate like elements.

Figure 1:
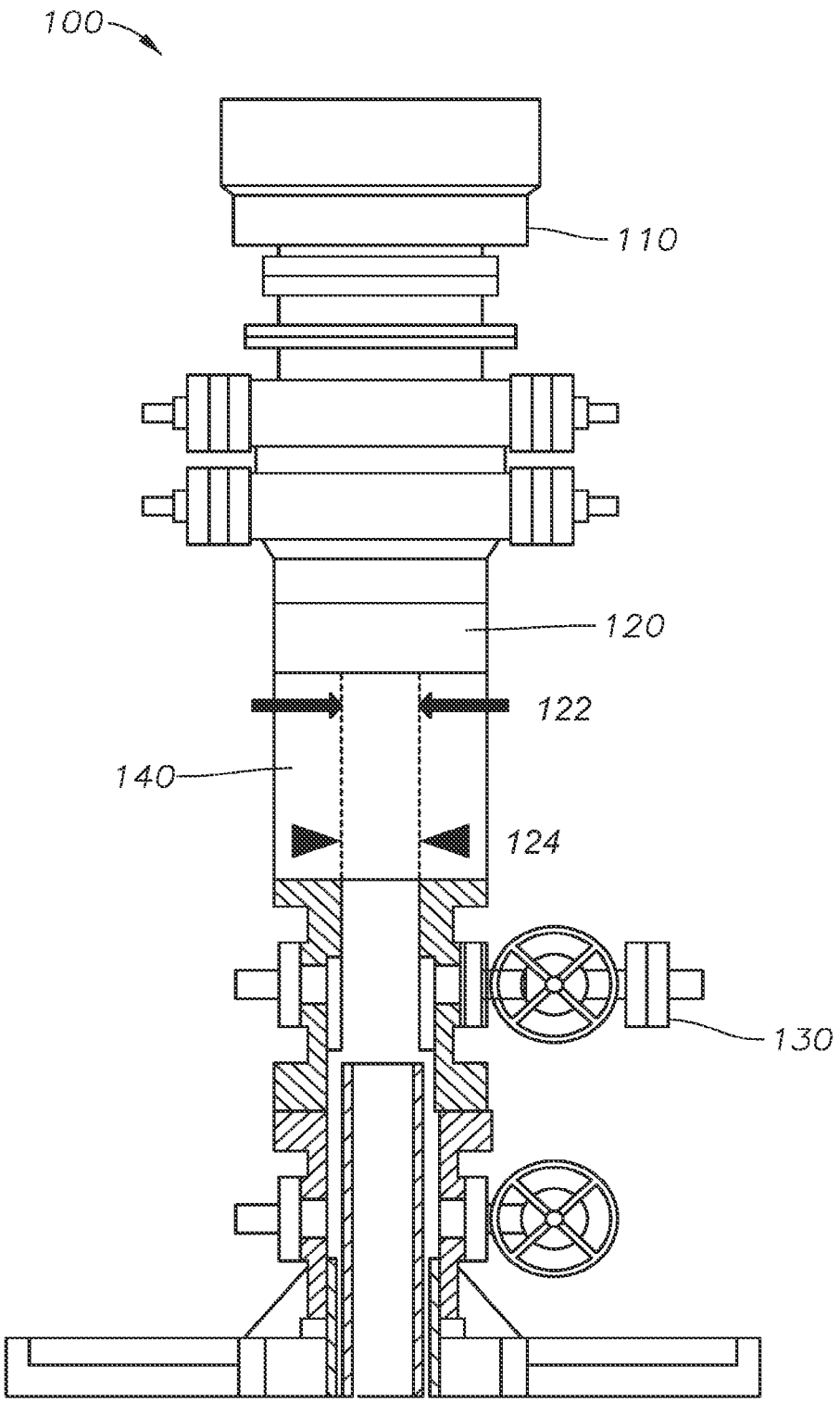
FIG. 1 illustrates a system for testing of a surface blowout preventer including a sacrificial wellhead adapter, according to one embodiment of the disclosure.

FIG. 1 illustrates a system 100 for testing of a blowout preventer, according to one embodiment of the disclosure. The system 100 includes a rig BOP 110, a BOP riser 120, and a sacrificial wellhead adapter 140 with a top locking mechanism 122 and a bottom locking mechanism 124 and an activated load mechanism. The sacrificial wellhead adapter 140 may be connected to a surface wellhead 130, which may be a conventional or multi-bowl wellhead on the platform floor.

Figure 2:
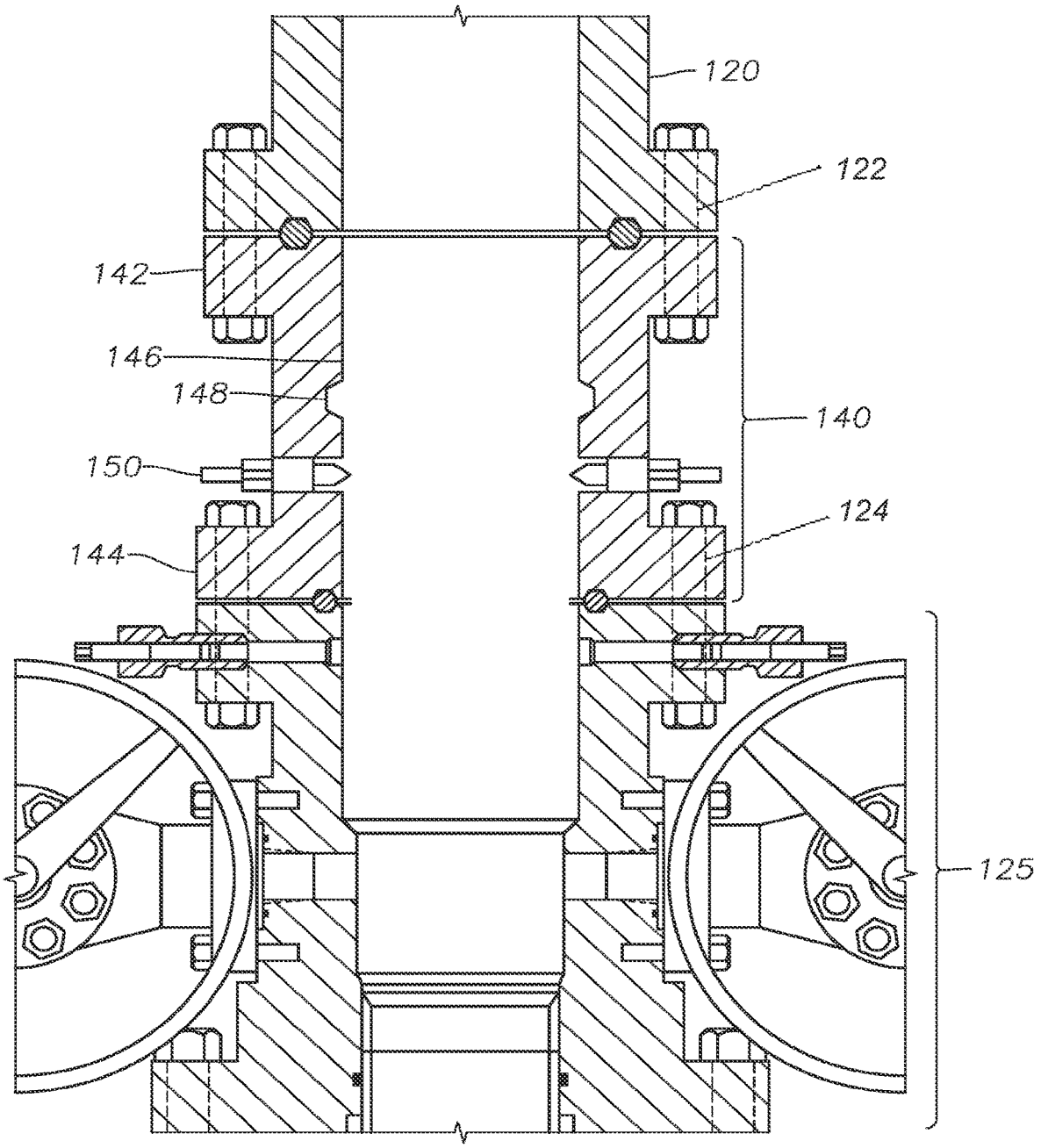
FIG. 2 illustrates a cross-sectional view of a system for testing of a surface blowout preventer including a sacrificial wellhead adapter, according to one embodiment of the disclosure.

FIG. 2 illustrates a cross-sectional view of the system 100 illustrated in FIG. 1. As illustrated in FIG. 2, the sacrificial wellhead adapter 140 can be installed between the permanent tubing or casing spool 125 and the BOP riser 120. The system 100 includes the sacrificial wellhead adapter 140, a top locking mechanism 122 adapted to lock the adapter 140 to a BOP riser 120 (such as a hex head cap screw, bolt, or a fastener), and a bottom locking mechanism 124 (such as a hex head cap screw, bolt, or a fastener) adapted to lock the adapter 140 to a permanent tubing or casing spool 125 of the surface wellhead. The sacrificial wellhead adapter 140 may include lock down screws 150 that may serve as an activated load ring or a tag point for the inserted load ring in the test plug. The sacrificial wellhead adapter 140 may have an upper connection 142, a lower connection 144, a special profile 148 for the test plug load ring, and a sealing profile 146 for the test plug. In the first stage, upon installation of the sacrificial wellhead adapter 140, the upper and lower connections 142, 144 are properly engaged, and the adapter 140 is pressure tested to confirm the seal integrity of the connections 142, 144.

Figure 3:
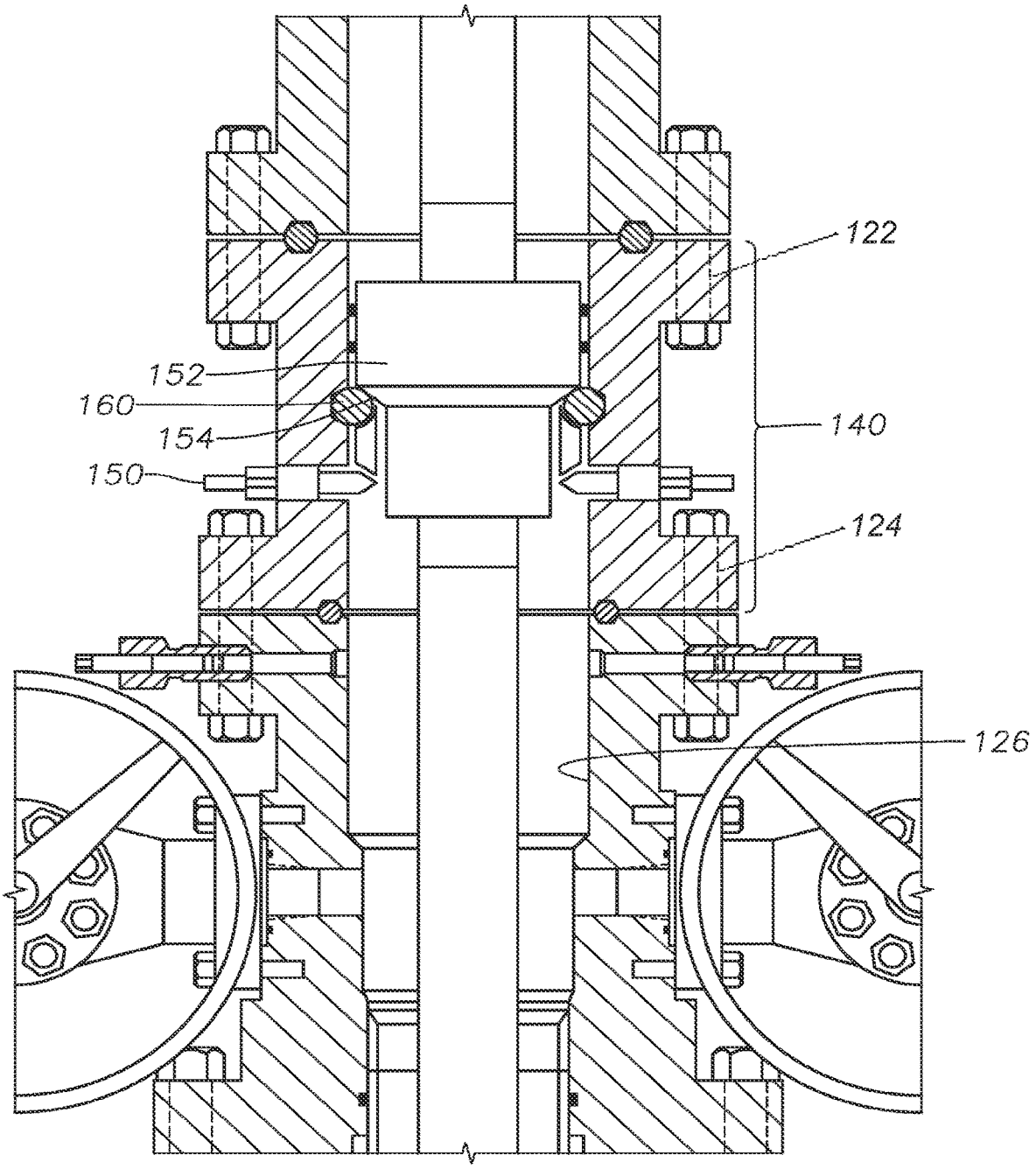
FIG. 3 illustrates a cross-sectional view of a system for testing of a surface blowout preventer including a sacrificial wellhead adapter and a special test plug, according to one embodiment of the disclosure.

FIG. 3 illustrates the second stage of installation where a special test plug 152 is run with an activated load shoulder 154. The load shoulder 154 is activated externally by energizing the lock down screws 150. If the load ring 160 locking the test plug 152 is not capable of taking the test plug 152 load, a double load ring can be used or additional lock down screws can be used to sustain the load during testing. Once the testing is completed successfully, the load ring 160 can be de-energized through straight pull. Then, the lock down screws 150 can be reactivated to be ready for running a bowl protector (shown in FIG. 4) to protect the sacrificial wellhead adapter 140 and the permanent casing or tubing spool seal profile 126.

Figure 4:
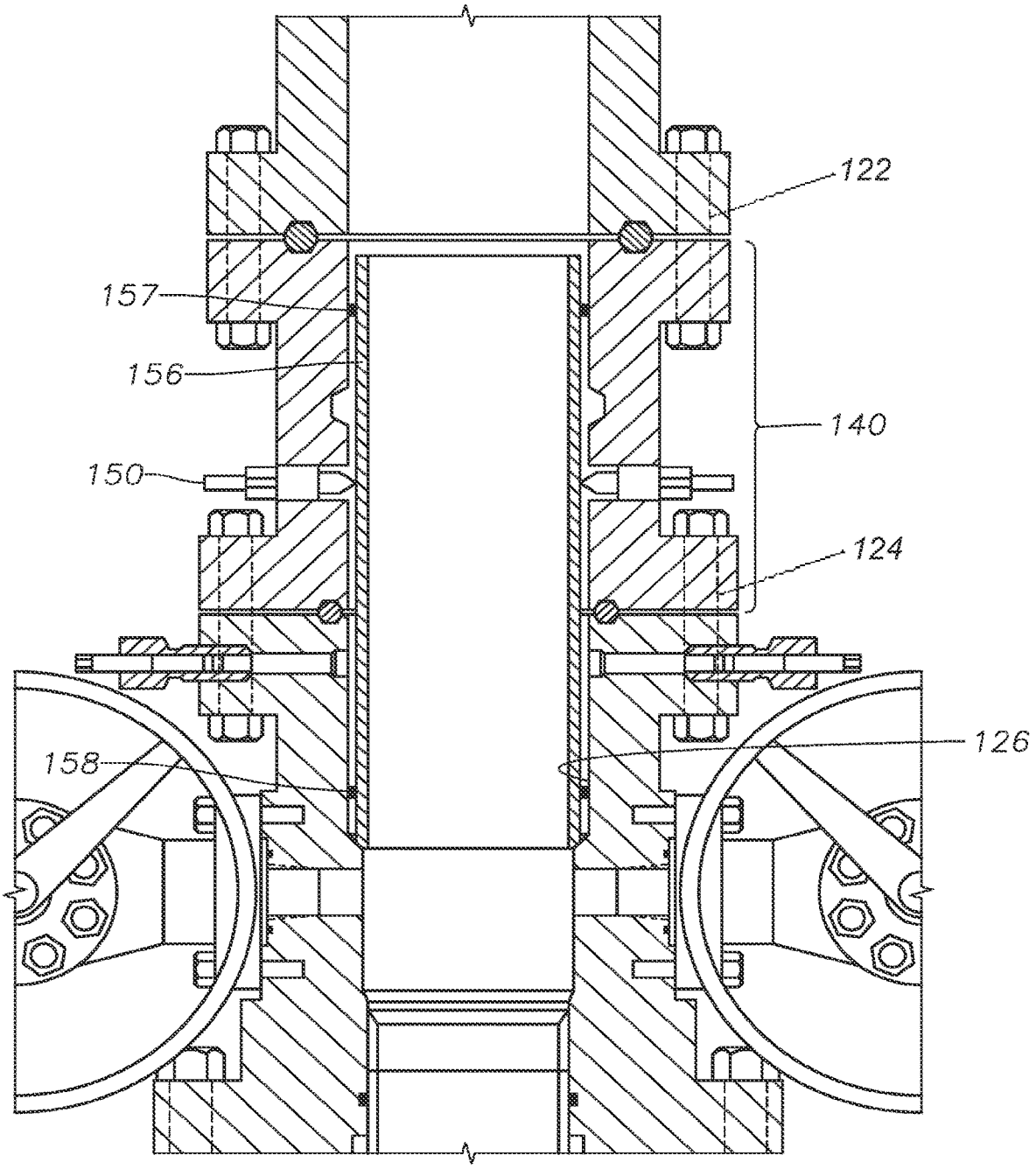
FIG. 4 illustrates a cross-sectional view of a system of a surface blowout preventer including a sacrificial wellhead adapter and a special bowl protector, according to one embodiment of the disclosure.

FIG. 4 illustrates the third stage where a special bowl protector 156 in run. The bowl protector 156 meets the required minimum bore and lands on the permanent tubing or casing spool profile 126. The bowl protector 156 can be equipped with two elastomeric seals 157, 158; a top elastomeric seal 157 and a bottom elastomeric seal 158. The purpose of the seals 157, 158 is to prevent junk from going to the sacrificial 146 and permanent spool profile 126. The bowl protector 156 can be retained in place by the lock down screws 150 in the sacrificial adapter 140. In the event the sacrificial spool profile is damaged, the sacrificial spool can be replaced without the need to replace the permanent tubing or casing spool.

Accordingly, one example embodiment is a method and apparatus for a sacrificial wellhead adapter with a special design to allow retaining the existing bowl protector in place and without the need to trip out and retrieve the whole drill string to conduct periodic testing. The sacrificial wellhead adapter is equipped with a special protector, and allows running and testing the BOP through a special test plug.

The adapter and special running procedure optimize the drilling operation by eliminating the time needed for tripping out of the hole to retrieve the bowl protector and conducting the periodic BOP testing. The sacrificial wellhead adapter is capable of taking the load of the test pressure and the drill string without the need to completely pull out the drill string to carry the required periodic BOP testing. This saves the rig time not less than eight hours as a result of avoiding pulling and running the drill string for each test.

The current practice mandates that the bowl protector is to be ran in the spool. When there is a BOP testing (for example, every two weeks), the drill string is pulled completely out of the hole and the bowl protector is retrieved. Testing is conducted and the drill string is ran again. Under the current set up, testing cannot be done while the drill string is in hole as this results in damages to the spool due the load of drill string.

The new spool has an energized load mechanism that is capable of taking the drill pipe, testing loads, and providing protection. This results in protection of existing spool and conducting the required BOP testing. The system can save at least eight hours of rig time as a result. Moreover, the embodiments disclosed can fully safeguard existing wellhead equipment from damages due to the bowl protector, and enable testing while the drill string is still suspended in the hole.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur.

While there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method operations, which perform substantially the same function in substantially the same way to achieve the same results, are within the scope of the disclosure. Moreover, it should be recognized that structures and/or elements and/or method operations shown and/or described in connection with any disclosed form or embodiment of the disclosure may be incorporated in any other disclosed or described or suggested form or embodiment as a general matter of design choice. It is the intention, therefore, to be limited only as indicated by the scope of the claims appended hereto.

Although only a few examples have been described in detail above, those skilled in the art will readily appreciate that many modifications are possible in the examples without materially departing from this subject disclosure. Accordingly, all such modifications are intended to be included within the scope of this disclosure as defined in the following claims. In the claims, means-plus-function clauses are intended to cover the structures described as performing the recited function and not only structural equivalents, but also equivalent structures.

The invention claimed is:

1. An apparatus for testing a blowout preventer (BOP) on a surface wellhead, the apparatus comprising:
- a sacrificial wellhead adapter;
- a top locking mechanism adapted to lock the adapter to a BOP riser;
- a bottom locking mechanism adapted to lock the adapter to a permanent tubing or casing spool of the surface wellhead;
- a plurality of lock down screws configured to be activated as a load ring;
- a test plug with an activated load shoulder; and
- a bowl protector to protect the sacrificial wellhead adapter and the permanent casing or tubing spool.

2. The apparatus according to claim 1, wherein the top locking mechanism includes an upper connection.

3. The apparatus according to claim 1, wherein the bottom locking mechanism includes a lower connection.

4. The apparatus according to claim 1, wherein the sacrificial wellhead adapter further comprises a first profile for accommodating a test plug load ring, and a sealing profile for a test plug.

5. The apparatus according to claim 1, wherein the test plug is activated externally by energizing the lock down screws.

6. The apparatus according to claim 1, further comprising a load ring configured to lock the test plug in place.

7. The apparatus according to claim 1, wherein the bowl protector comprises a top elastomeric seal and a bottom elastomeric seal.

8. The apparatus according to claim 1, wherein the bowl protector is retained in place by the lock down screws.

9. The apparatus according to claim 1, wherein the surface wellhead is a conventional or multi-bowl wellhead.

10. A method of testing a blowout preventer (BOP) on a surface wellhead, the method comprising:
- coupling a sacrificial wellhead adapter to a permanent tubing or casing spool of the surface wellhead;
- coupling a BOP riser to the sacrificial wellhead adapter;
- providing a plurality of lock down screws configured to be activated as a load ring;
- pressure testing the sacrificial wellhead adapter;
- running a test plug;
- locking the test plug in place by means of a load ring;
- energizing the lock down screws;
- running a bowl protector to protect the sacrificial wellhead adapter and the permanent casing or tubing spool; and
- testing the BOP.

11. The method according to claim 10, wherein the bowl protector comprises a top elastomeric seal and a bottom elastomeric seal.

12. The method according to claim 10, wherein the bowl protector is retained in place by the lock down screws.

13. A well tool for testing a blowout preventer (BOP) on a surface wellhead, the apparatus comprising:

a sacrificial wellhead adapter;

a top locking mechanism adapted to lock the adapter to a BOP riser;

a bottom locking mechanism adapted to lock the adapter to a permanent tubing or casing spool of the surface wellhead;

a plurality of lock down screws configured to be activated as a load ring;

a test plug with an activated load shoulder; and a bowl protector to protect the sacrificial wellhead adapter and the permanent casing or tubing spool.

* * * * *